US007446724B2

(12) United States Patent
Shimoda

(10) Patent No.: US 7,446,724 B2
(45) Date of Patent: Nov. 4, 2008

(54) MONOPOLE ANTENNA

(75) Inventor: Hideaki Shimoda, Tokyo (JP)

(73) Assignee: TDK Corporation, Tokyo (JP)

( * ) Notice: Subject to any disclaimer, the term of this patent is extended or adjusted under 35 U.S.C. 154(b) by 155 days.

(21) Appl. No.: 11/508,234

(22) Filed: Aug. 23, 2006

(65) Prior Publication Data

US 2007/0046546 A1 Mar. 1, 2007

(30) Foreign Application Priority Data

Aug. 31, 2005 (JP) ..... 2005-251192
Sep. 26, 2005 (JP) ..... 2005-278295

(51) Int. Cl.
*H01Q 7/08* (2006.01)
*H01Q 1/36* (2006.01)

(52) U.S. Cl. ..... 343/788; 343/895

(58) Field of Classification Search ..... 343/788, 343/895

See application file for complete search history.

(56) References Cited

U.S. PATENT DOCUMENTS 5,140,700 A * 8/1992 Kennedy ..... 455/142
6,639,564 B2 10/2003 Johnson
7,202,778 B2 * 4/2007 Buenz et al. ..... 340/448
2003/0151557 A1 8/2003 Johnson
2004/0201468 A1 * 10/2004 Zimmer ..... 340/448
2007/0040643 A1 * 2/2007 Inoue et al. ..... 336/213

FOREIGN PATENT DOCUMENTS

| | | |
|---|---|---|
| JP | A 9-121114 | 5/1997 |
| JP | A 11-195917 | 7/1999 |
| JP | A 2000-82914 | 3/2000 |
| JP | A 2002-374122 | 12/2002 |
| JP | A 2003-249810 | 9/2003 |
| JP | A 2004-007510 | 1/2004 |
| JP | A 2004-193774 | 7/2004 |
| JP | A 2004-363859 | 12/2004 |
| JP | A 2005-094742 | 4/2005 |
| JP | A-2005-518125 | 6/2005 |

* cited by examiner

*Primary Examiner*—Tan Ho
(74) *Attorney, Agent, or Firm*—Oliff & Berridge, PLC

(57) ABSTRACT

A monopole antenna comprising an antenna conductor to transmit or receive a radio wave, and an inductor either inserted in the antenna conductor or connected to an end of the antenna conductor. The inductor includes a first conductor electrically connected to the antenna conductor, and a magnetic material adjacent to the first conductor. The permeability of the magnetic material varies with a negative gradient with respect to the frequency of the radio wave.

9 Claims, 19 Drawing Sheets

(a)

(b)

(a)

(b)

(a)

(b)

(a)

(b)

(b)

(a)

MONOPOLE ANTENNA

BACKGROUND OF THE INVENTION

1. Field of the Invention

The present invention relates to an antenna for transmitting or receiving radio waves.

2. Related Background Art

A variety of antennas with a conductor pattern as an antenna element on a base are known. For example, Japanese Patent Application Laid Open No. 2000-82914 discloses a microstrip antenna having a base made of a magnetic material, and Japanese Patent Application Laid Open No. H9-121114 discloses a microstrip antenna having a base made of a dielectric material. Further, Japanese Patent Applications Laid Open Nos. 2004-363859 and 2002-374122 disclose antennas having a base made of a dielectric material or magnetic material.

It is an important object to reduce the physical dimension of antennas to be set in small devices while keeping a wide operating frequency bandwidth for the antennas. In order to obtain a small antenna, it is effective to insert a reactance element in the antenna element. However, in this case, there is a problem that the operating frequency bandwidth is narrow.

SUMMARY OF THE INVENTION

An object of the present invention is to broaden the operating frequency bandwidth of antennas while suppressing the enlargement thereof.

A monopole antenna in accordance with the present invention comprises an antenna conductor adapted to transmit or receive a radio wave having a frequency, and an inductor either inserted in the antenna conductor or connected to an end of the antenna conductor. The antenna conductor may be a conductor wire, or may be a conductor pattern provided on a support. The inductor includes a first conductor electrically connected to the antenna conductor, and a magnetic material adjacent to the first conductor. The magnetic material has a permeability varying with a negative gradient with respect to the frequency of the radio wave.

The permeability does not always need to vary with a negative gradient with respect to all the frequencies, and may instead vary with a negative gradient within a certain frequency region. If the monopole antenna is used in a frequency bandwidth containing at least part of the frequency region, it is possible to broaden the operating frequency bandwidth of the monopole antenna.

In one embodiment, the monopole antenna further comprises a support plate having a principal face for the antenna conductor and the inductor to be disposed on, and a grounding conductor provided on the principal face of the support plate.

The inductor may further include a first electrode electrically connected to a first end of the first conductor, and a second electrode electrically connected to a second end of the first conductor. The first conductor may be electrically connected to the antenna conductor via at least one of the first and second electrodes.

The first conductor may be embedded in the magnetic material. The first conductor may extend straight or helically, or may meander. The antenna conductor may include a second conductor having an end connected to an end of the first conductor. The end of the first conductor has a first cross-sectional area perpendicular to a direction of current flow in the first conductor. The end of the second conductor has a second cross-sectional area perpendicular to a direction of current flow in the second conductor. The first cross-sectional area may be smaller than the second cross-sectional area.

Alternatively, the first conductor may be wound around the magnetic material.

In another embodiment, the antenna conductor and the first conductor each include a conductor wire.

The inductor may include a coil having the first conductor, and the first conductor may be wound around the magnetic material. Alternatively, the first conductor may be embedded in the magnetic material. The first conductor may extend in a straight-line shape or helical shape, or may meander within the magnetic material. The antenna conductor may include a second conductor having an end connected to an end of the first conductor. The end of the first conductor has a first cross-sectional area perpendicular to a direction of current flow in the first conductor. The end of the second conductor has a second cross-sectional area perpendicular to a direction of current flow in the second conductor. The first cross-sectional area may be smaller than the second cross-sectional area.

The present invention will become more fully understood from the detailed description given hereinbelow and the accompanying drawings which are given by way of illustration only, and thus are not to be considered as limiting the present invention.

DESCRIPTION OF THE PREFERRED EMBODIMENTS

Figure 1:
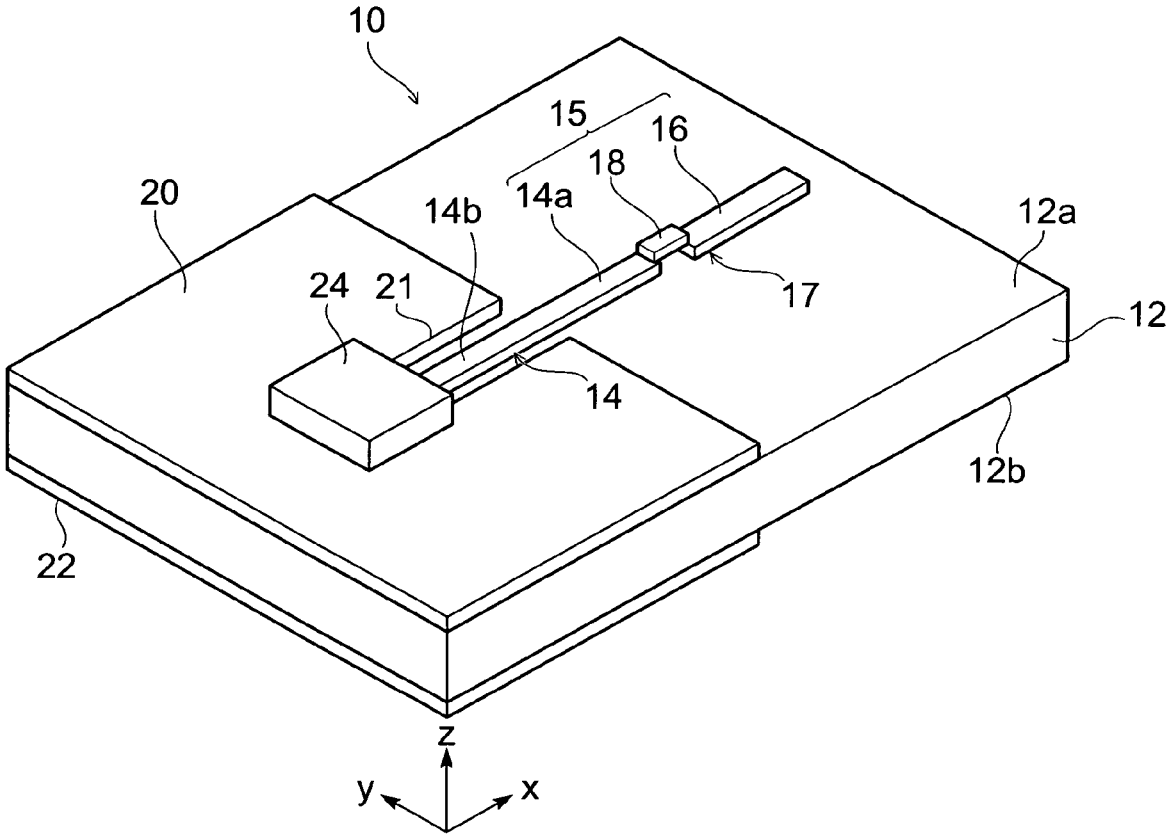
FIG. 1 is a schematic perspective view of an antenna of the first embodiment.

The preferred embodiments of the present invention will be described below in greater detail with reference to the accompanying drawings. To facilitate understanding, identical reference numerals are used, where possible, to designate identical or equivalent elements that are common to the embodiments, and, in subsequent embodiments, these elements will not be further explained.

First Embodiment

Figure 2:
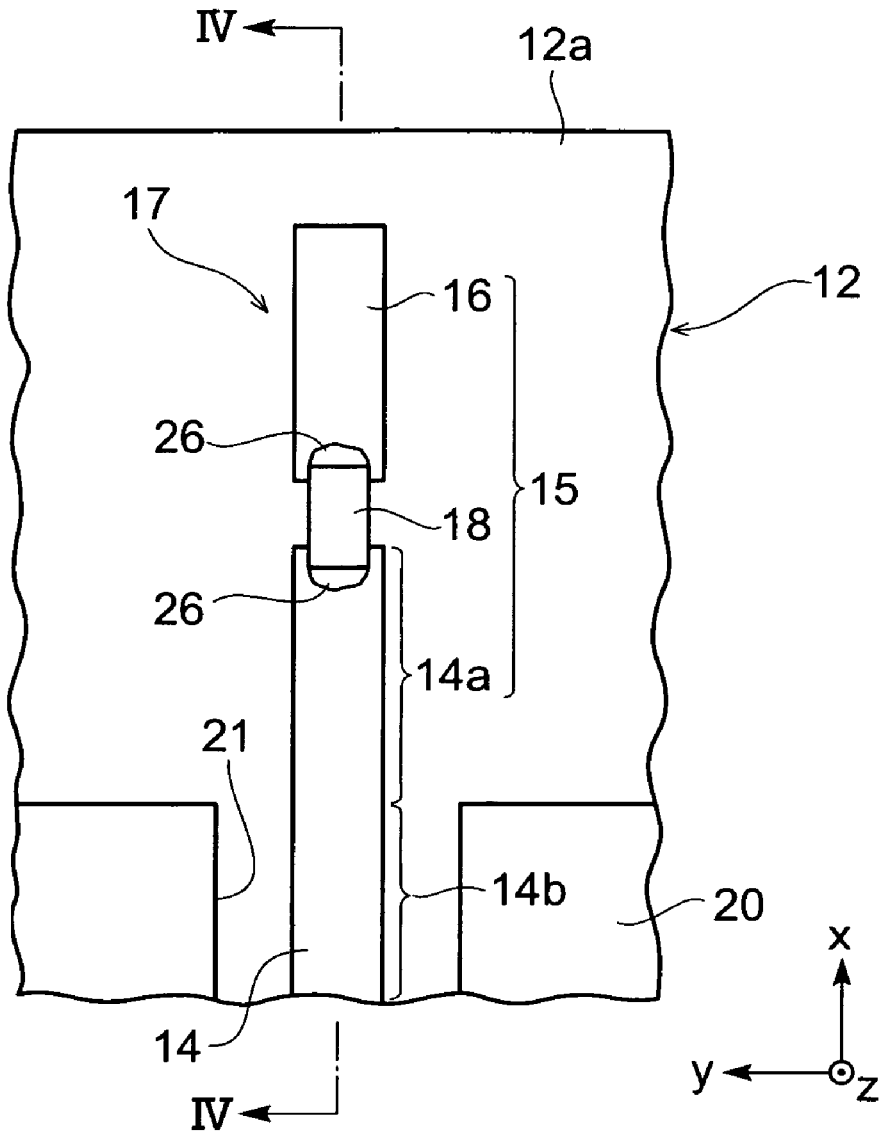
FIG. 2 is a partial plan view of the antenna of the first embodiment.

FIGS. 1 and 2 are a schematic perspective view and a partial plan view of a monopole antenna according to the first embodiment of the present invention. An xyz orthogonal coordinate system is also shown in FIGS. 1 and 2. The monopole antenna 10 includes a support plate 12 made of a dielectric material, an antenna element 15 provided on one principal face 12*a* of the support plate 12, and a thin film grounding conductor 20 provided on the principal face 12*a*. Such a planar monopole antenna 10 is suitable for small communication devices. The antenna 10 is mainly described as a transmitting antenna, and the antenna element 15 is mainly described as a transmitting element hereinbelow. However, the antenna 10 naturally has an ability to receive radio waves, and therefore the antenna element 15 is also a receiving element.

The antenna element 15 is configured of two separate strip antenna conductors 14*a* and 16, and an inductor 18 electrically connected between these antenna conductors. When regarding the antenna conductors 14*a* and 16 as two parts into which one antenna conductor 17 is divided, the inductor 18 is inserted in the antenna conductor 17, and connected to the antenna conductor 17 in series. The two antenna conductors 14*a* and 16 extend coaxially in x direction. The opposite ends of the inductor 18 are fixed on the upper faces of the antenna conductors 14*a* and 16 so that the inductor 18 forms a bridge across these antenna conductors.

The conductor 14*a* is a portion of a longer strip conductor 14 provided on the principal face 12*a* of the support plate 12. The conductors 14 and 16 have a common, constant thickness and width. The conductor 14*a* is a part of the conductor 14 which protrudes from one end of the grounding conductor 20. A part 14*b* excluding the conductor 14*a* of the conductor 14 extends inside a cut-out 21 of the grounding conductor 20. The conductor 14*b* is a transmission line for transmitting electric signals, and acts as an electric supply line for the antenna element 15.

Figure 3:
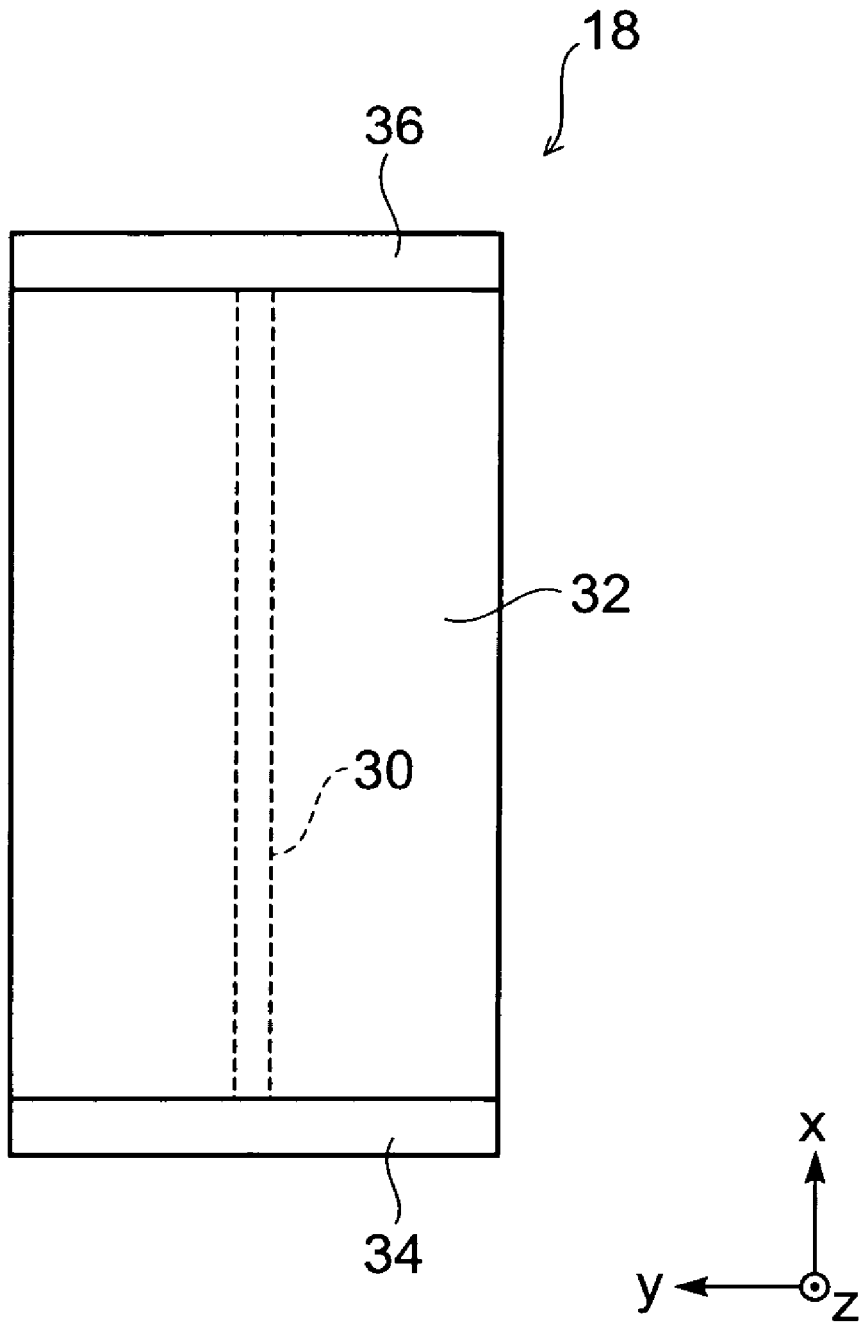
FIG. 3 is a plan view of an inductor in the first embodiment.
Figure 4:
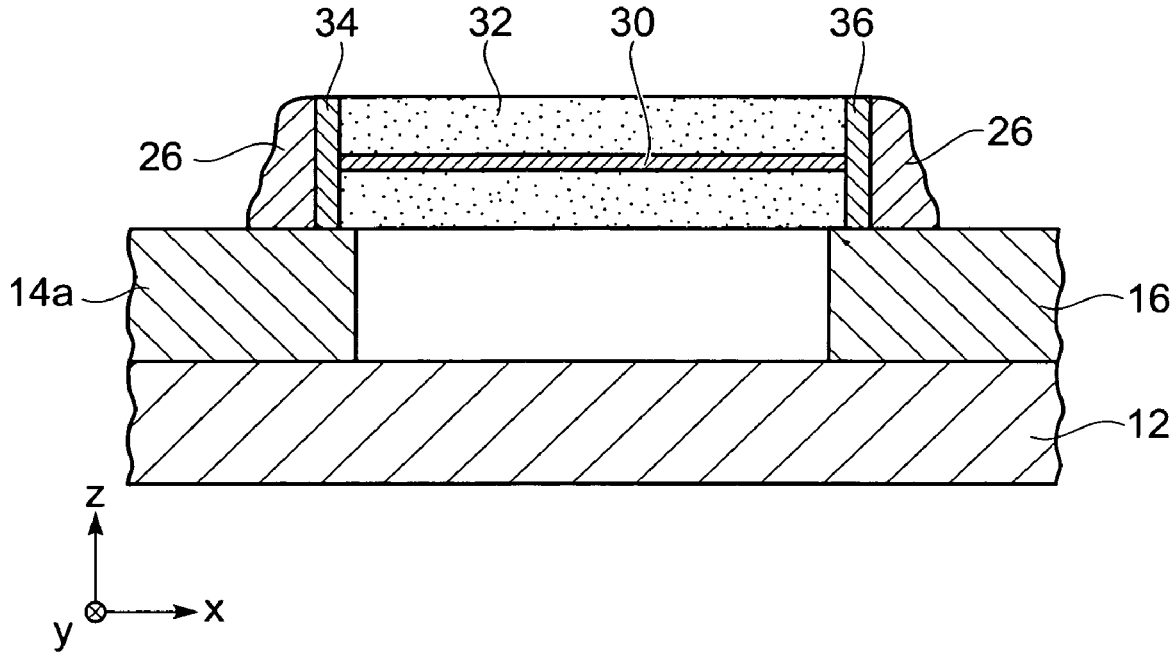
FIG. 4 is a partially sectional view taken along line IV-IV in FIG. 2.

The structure of the inductor 18 will be described hereinbelow with reference to FIGS. 3 and 4. FIG. 3 is a plan view of the inductor 18, and FIG. 4 is a partially sectional view along line IV-IV in FIG. 2. The inductor 18 contains an electric conductor 30 electrically connected between the antenna conductors 14*a* and 16. In this embodiment, the conductor 30 is an elongated, straight-line conductor. The sides of the conductor 30 are covered with a magnetic material 32 along the full length of the sides.

Two electrodes 34 and 36 are provided at the opposite ends of the inductor 18. The inductor 18 can be easily connected to the antenna conductors 14*a* and 16 via these electrodes. The electrodes 34 and 36 are electrically connected to the opposite ends of the conductor 30. As shown in FIGS. 2 and 4, the electrode 34 is connected to the antenna conductor 14*a*, and the electrode 36 to the antenna conductor 16, by electrically conductive adhesive 26 (solder, for example). As a result, the conductor 30 in the inductor 18 is electrically connected between the antenna conductors 14*a* and 16. Because the cross-sectional area (sectional area perpendicular to x direction in which currents flow) of the conductor 30 is smaller than that of the antenna conductors 14*a* and 16, the conductor 30 serves as an inductor when a current flows between these conductors. The magnetic material 32 connected to the conductor 30 acts to raise the inductance of the inductor.

Referring to FIGS. 1 and 2 again, the grounding conductor 20 has a width (length in y direction) sufficiently larger than those of the antenna conductors 14*a* and 16. The longitudinal direction of the antenna conductors 14*a* and 16 is perpendicular to one side of the grounding conductor 20 which is closest to the antenna element 15. Therefore, the monopole antenna 10 is one of so-called ground-mounted vertical antennas.

The grounding conductor 20 has a cut-out 21, and the conductor 14*b* extends inside the cut-out 21 from one end of the antenna element 15. A second grounding conductor 22 is provided on the other principal face 12*b* of the support plate 12, and overlaps the grounding conductor 20 with the support plate 12 interposed between these conductors. The conductor 14*b* is disposed above the grounding conductor 22 with the support plate 12, which is a dielectric, interposed between the conductor 14*b* and the grounding conductor 22. Hence, the conductor 14*b* acts as a microstrip line.

A radio-frequency (RF) circuit 24 is mounted on the grounding conductor 20, and the conductor 14*b* is electrically connected to the radio-frequency circuit 24. When a radio-frequency power is supplied from the radio-frequency circuit 24 to the antenna element 15, a radio wave can be emitted from the antenna element 15. When the antenna 10 is used as a transmitting antenna, a transmitter module may be installed as the radio-frequency circuit 24. Other circuits electrically connected to the radio-frequency circuit 24 may also be installed in the periphery of the radio-frequency circuit 24.

In a case where the antenna 10 is used as a receiving antenna, when the antenna element 15 receives a radio wave, the antenna element 15 converts the radio wave into a radio-frequency electric signal, and supplies the electric signal to the radio-frequency circuit 24 via the conductor 14*b*. The radio-frequency circuit 24 may be a receiver module that processes an electric signal from the antenna element 15 or may be a module that acts as both a receiver and a transmitter.

As mentioned earlier, the antenna element 15 is configured to have an inductor, which is a reactance element, inserted in the antenna conductor. As is commonly known, the inductor contributes to reduction in the height of the antenna element with respect to the grounding conductor. This fact will be described hereinbelow with reference to FIG. 5.

Figure 5:
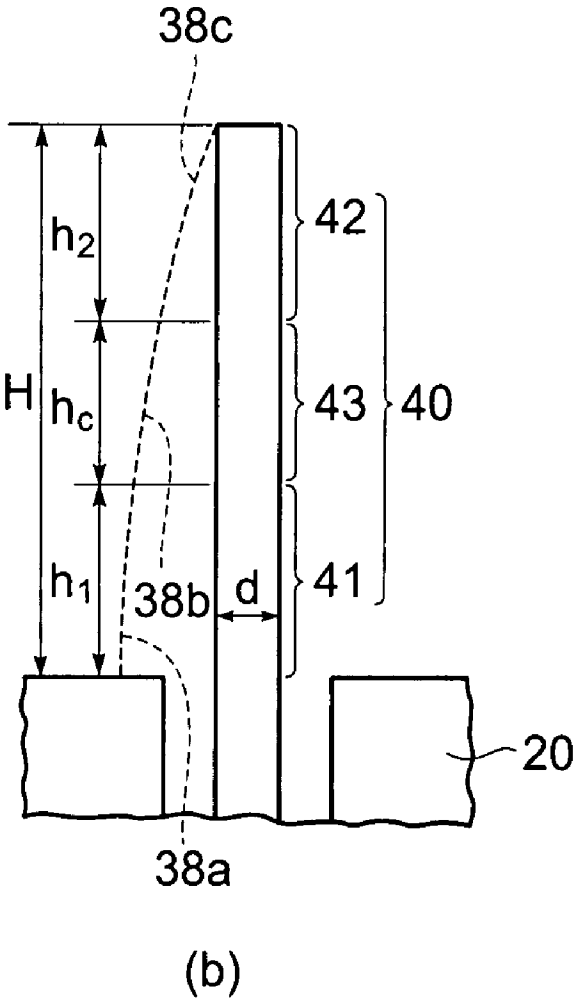
FIG. 5 is a schematic plan view to illustrate reduction of the height of an antenna conductor.
Figure 5:
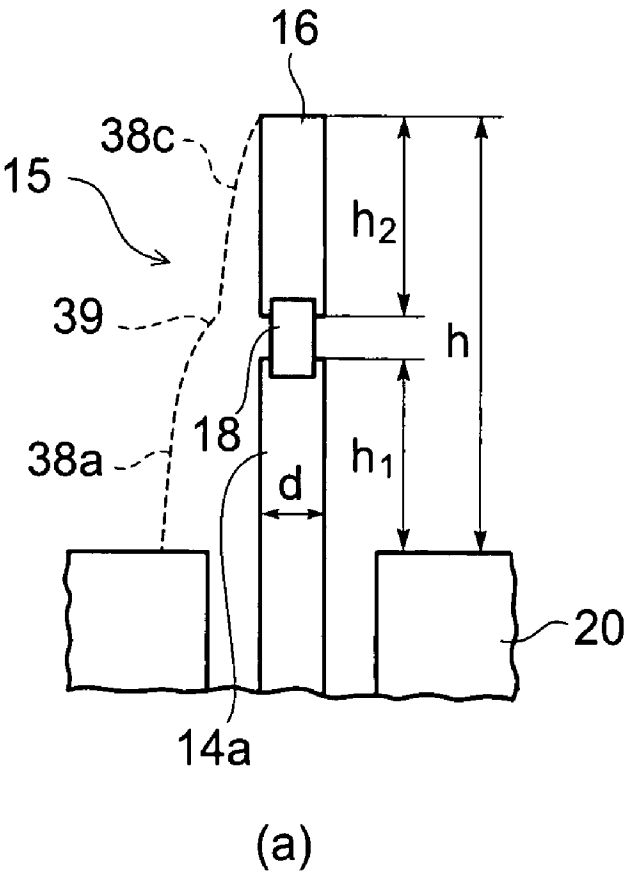

FIG. 5 is a schematic plan view to illustrate the reduction in the height of the antenna, where (a) shows a partial plan view of the antenna element 15 of this embodiment, and (b) a partial plan view of an antenna element including an antenna conductor 40 but not including an inductor inserted in the conductor 40. The strip antenna conductor 40 has a width d same as those of the antenna conductors 14*a* and 16. The antenna conductor 40 includes three successive parts 41, 42 and 43, and the parts 41 and 43 have lengths $h_1$ and $h_2$ which are same as those of the antenna conductors 14*a* and 16, respectively.

The broken lines in FIGS. 5(*a*) and (*b*) represent the amplitude of the current in the antenna conductor. As shown in FIG. 5(*a*), the reactance generated by the inductor 18 provides a current amplitude distribution 39 that changes sharply along the length of the antenna conductor, between current amplitude distributions 38*a* and 38*c* in the antenna conductors 14*a* and 16. As shown in FIG. 5(*b*), in order to connect the current amplitude distributions 38*a* and 38*c* by means of only the antenna conductor 40 without using the inductor 18, it is necessary to use an antenna conductor 43 (with length $h_c$) that is longer than the inductor 18 to provide a current amplitude distribution 38*b* that smoothly connects the current amplitude distributions 38*a* and 38*c*. It is clear from this fact that the height of the antenna element with respect to the grounding conductor can be reduced by inserting the inductor 18 in the antenna conductor. This means that the antenna element 15 in which the inductor 18 is loaded apparently operates in the same way as the antenna conductor 40 with height H configured of only the antenna conductors 41-43, as shown in FIG. 5(*b*).

The appropriate reactance of the inductor 18 will now be studied. As is commonly known, the reactance of an inductor connected to an antenna conductor of a monopole antenna preferably satisfies the following equation:

$$\frac{X_L}{K_a} = \cot\left(\frac{2\pi}{\lambda}h_2\right) - \cot\left[\frac{2\pi}{\lambda}(H - h_1)\right], \tag{1}$$

where $X_L$ is the reactance of the inductor 18, and $K_a$ is the average characteristic impedance of the antenna elements 14*a* and 16. $K_a$ is a constant determined in accordance with the shape of the antenna conductors 14*a* and 16, the shape of the grounding conductor 20, and the material of the support plate 12, and so forth. H is the apparent height of the antenna element 15 with respect to the grounding conductor 20, as shown in FIG. 5(*b*). $h_1$ is the length of the antenna conductor 14*a*, $h_2$ is the length of the antenna conductor 16, and λ is the wavelength of the radio wave transmitted or received by the antenna element 15.

For the sake of simplification, H is set at a typical (¼) λ hereinbelow. Here, Equation (1) is rewritten as follows:

$$\frac{X_L}{K_a} = \cot\left(\frac{2\pi}{\lambda}h_2\right) - \tan\left(\frac{2\pi}{\lambda}h_1\right). \tag{2}$$

Equations (1) and (2) appear in Hiroshi Kadoi and Hiromitsu Yoshimura, "Antenna handbook," Japan, CQ publisher, p. 390-391, 1985.

Figure 6:
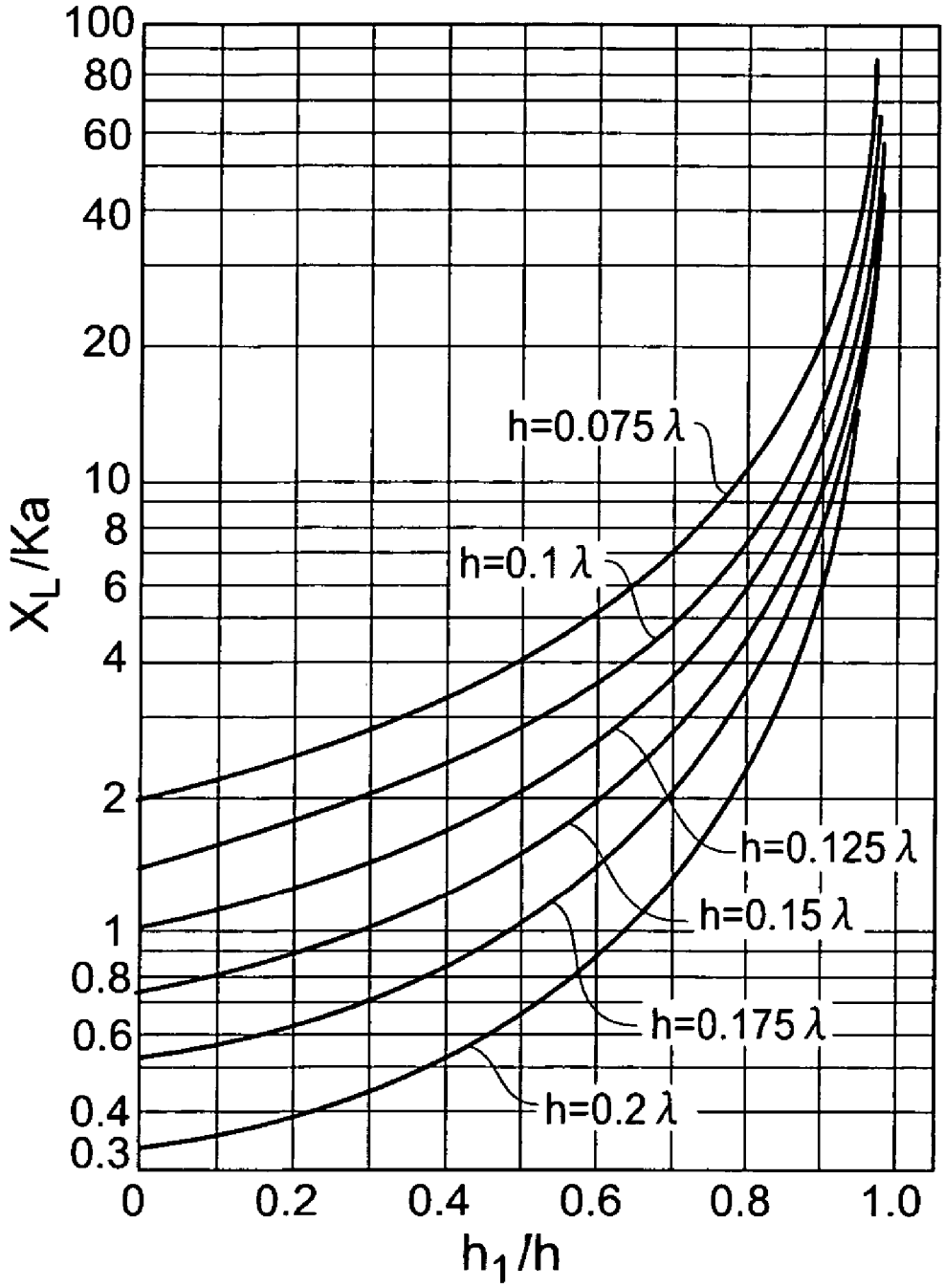
FIG. 6 is a graph showing the relationship between the position of the inductor in the antenna conductor and the reactance of the inductor.

FIG. 6 is a graph showing the relationship between $h_1/h$ and $X_L/K_a$ based on Equation (2). Here, $h_1/h$ is a parameter representing a position at which the inductor 18 is inserted in the antenna conductor. In FIG. 6, graphs are drawn for respective cases where the height h of the antenna element 15 has various proportionality coefficients (0.075, 0.1 and so forth) with respect to the wavelength. As shown in FIG. 6, the appropriate value of $X_L/K_a$ decreases as the proportionality coefficient increases when $h_1/h$ is fixed. Because $K_a$ is a constant, the appropriate reactance $X_L$ of the inductor 18 decreases with increase in the proportionality coefficient of height h of the antenna element 15 to wavelength λ.

Figure 7:
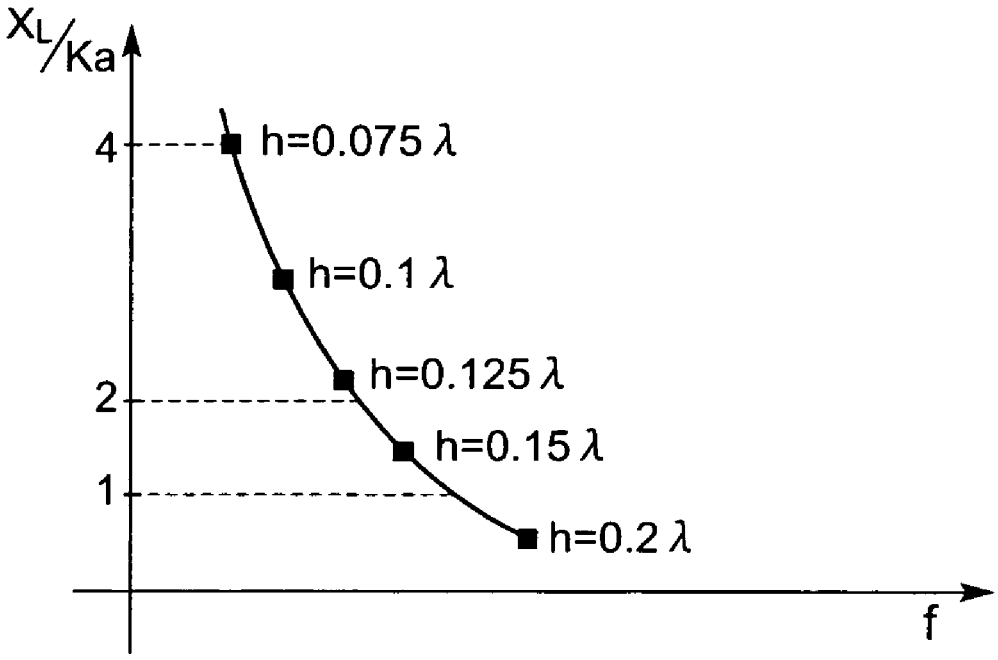
FIG. 7 is a graph showing the relationship between the appropriate reactance of the inductor and the frequency.

The relationship between the appropriate $X_L/K_a$ and the frequency f of the radio wave transmitted or received by the antenna element 15 will be now studied. FIG. 7 is a graph showing the relationship between frequency f and $X_L/K_a$ satisfying Equation (2) under the condition where $h_1=h_2$, $h_1/h=0.5$, and h is constant. The plotted points indicated by black squares in FIG. 7 correspond to the points of intersection between the straight line $h_1/h=0.5$ and the graphs in FIG. 6.

As mentioned above, if the position of the inductor 18 is fixed, the appropriate $X_L/K_a$ decreases as the proportionality coefficient of h to λ increases. On the other hand, in order to keep constant the height h of the antenna element 15, which is expressed as wavelength λ multiplied by the proportionality coefficient, λ needs to decrease as the proportionality coefficient increases. Because λ and f are inversely proportional as is well known, f needs to increase as the proportionality coefficient increases in order to keep h constant. Therefore, if $X_L$ decreases with increase in f as shown in FIG. 7, an appropriate $X_L/K_a$ can be obtained at various frequencies without changing height h of the antenna element 15. This means that it is possible to obtain a monopole antenna that can be operated over a wide frequency bandwidth, without increasing the size of the antenna.

As is clear from FIG. 6, such a feature of $X_L/K_a$ is also the same for other values of $h_1/h$. Further, even when H has a value other than (¼) λ, $X_L/K_a$ exhibits the same feature based on Equation (1). Although the above study is carried out in view of keeping h constant, it is possible for the frequency characteristic of $X_L/K_a$ to at least approximate to an ideal curve shown in FIG. 7 if $X_L$ changes with a negative gradient with respect to f. Therefore, in comparison with a case where $X_L$ changes with a positive gradient with respect to f, an adequate antenna performance can be obtained when $X_L/K_a$ approaches an ideal value over a wider frequency bandwidth while keeping h constant. As a result, it is possible to broaden the frequency bandwidth in which the antenna 10 can operate (that is, in which the antenna 10 can be used), while suppressing the enlargement of the antenna 10.

In the present embodiment, in order to obtain the above frequency characteristic of reactance $X_L$, a magnetic material 32 having a permeability μ that varies with a negative gradient as frequency f increases is used for the inductor 18. This will be described hereinbelow with reference to FIG. 8.

Figure 8:
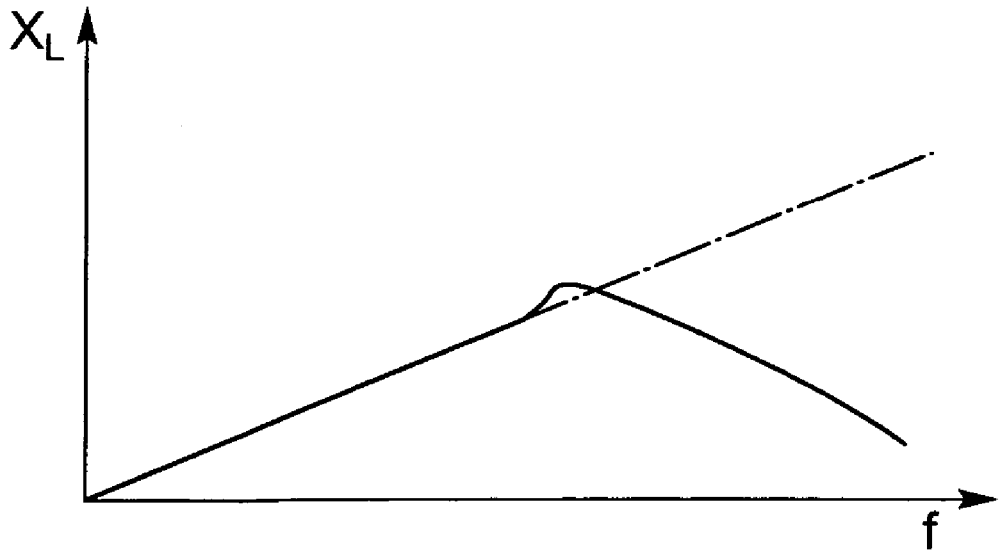
FIG. 8 is a graph showing the frequency characteristic of the reactance with respect to the frequency characteristic of the permeability of a magnetic material.

As is well known, the following relationship $$X_L = 2\pi fL \tag{3}$$

is established between reactance $X_L$ and inductance L of the inductor. FIG. 8 is a graph showing the frequency characteristic of reactance $X_L$ corresponding to the frequency characteristic of permeability μ of the magnetic material 32. The dot-dashed line in FIG. 8 shows the frequency characteristic of $X_L$ in a case where permeability μ is constant and does not depend on the frequency f Since inductance L of the inductor 18 is proportional to permeability μ of the magnetic material 32, f and $X_L$ are proportional if μ is constant regardless of f. On the other hand, the solid line in FIG. 8 represents the frequency characteristic of $X_L$ in a case where permeability μ of the magnetic material 32 varies with a negative gradient (differential coefficient) with respect to frequency f in a partial frequency region. In a frequency region in which permeability μ varies with a sufficiently large negative gradient with respect to frequency f, $X_L$ decreases with increase in f, as shown in FIG. 8.

Figure 9:
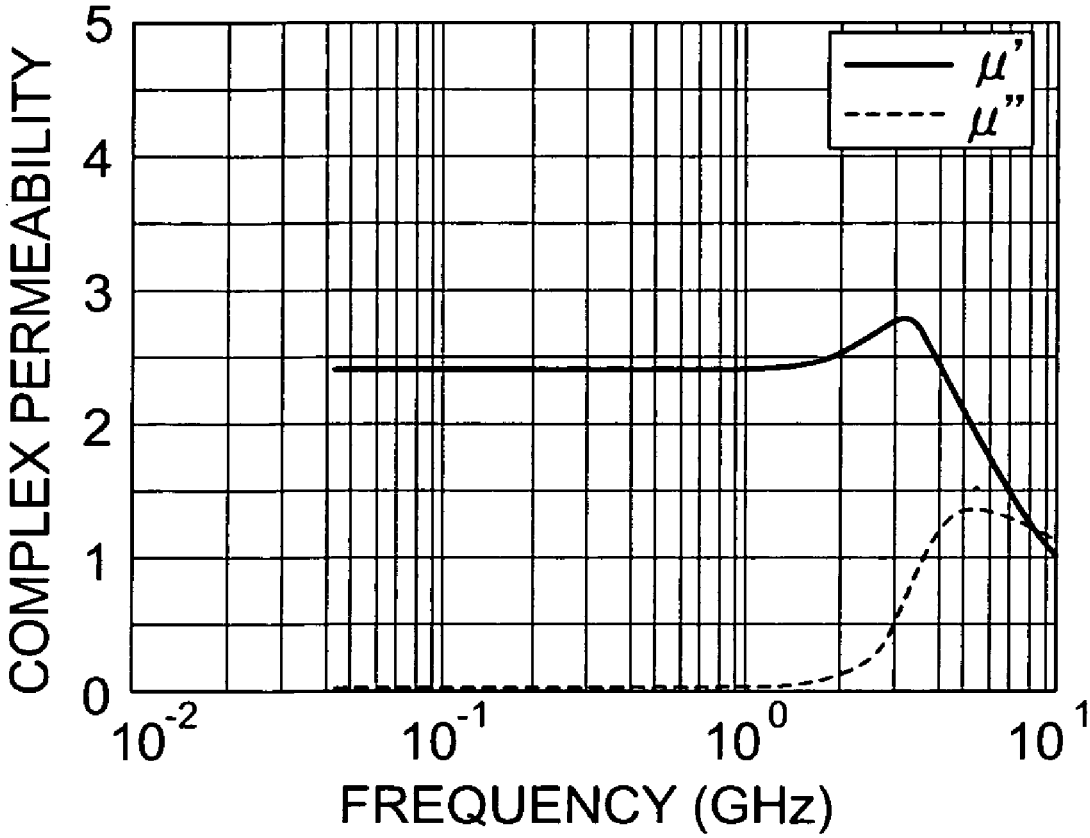
FIG. 9 shows an example of the frequency characteristic of the permeability of the magnetic material.

In this embodiment, a hexagonal-system ferrite with the characteristic shown in FIG. 9 is used as a material of the magnetic material 32. Here, FIG. 9 shows the frequency characteristic of the permeability of the hexagonal-system ferrite. A hexagonal-system ferrite is a magnetic material containing iron oxide as the main component, but also has the properties of a dielectric. In FIG. 9, μ' and μ" represent the real part and imaginary part, respectively, of the complex number representation of permeability μ. Here, permeability μ is denoted by $\mu=\mu'-j\mu''$. The magnitude of permeability μ is equal to $(\mu'^2+\mu''^2)^{1/2}$.

As shown in FIG. 9, μ' is substantially constant for magnetic waves of low frequencies. However, at sufficiently high frequencies, μ' drops as the frequency increases, that is, varies with a negative gradient (differential coefficient) with respect to the frequency. μ" is 0 at low frequencies; however, at high frequencies, μ" varies with a negative gradient with respect to the frequency. Therefore, in a sufficiently high frequency region, the permeability μ varies with a negative gradient with respect to the frequency, and consequently, the frequency characteristic of reactance $X_L$ indicated by the solid line in FIG. 8 is obtained.

Thus, a characteristic identical or approximate to the ideal frequency characteristic of $X_L/K_a$ shown in FIG. 7 can be obtained by using the inductor 18 having the magnetic material 32 with a permeability that varies with a negative gradient with respect to frequency f. As a result, it is possible to broaden the operating frequency bandwidth of the antenna 10 while suppressing the enlargement of the antenna 10.

Figure 10:
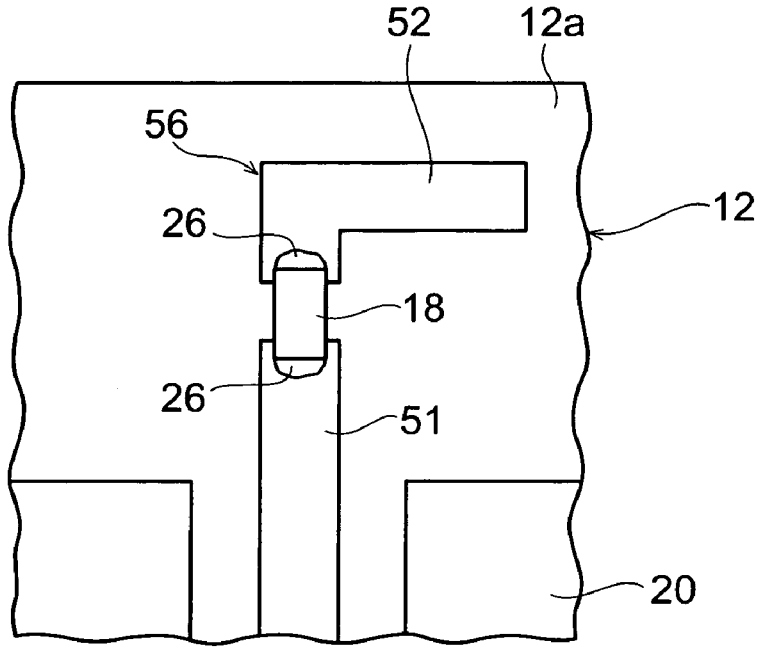
FIG. 10 is a plan view showing various shapes of the antenna element.
Figure 10:
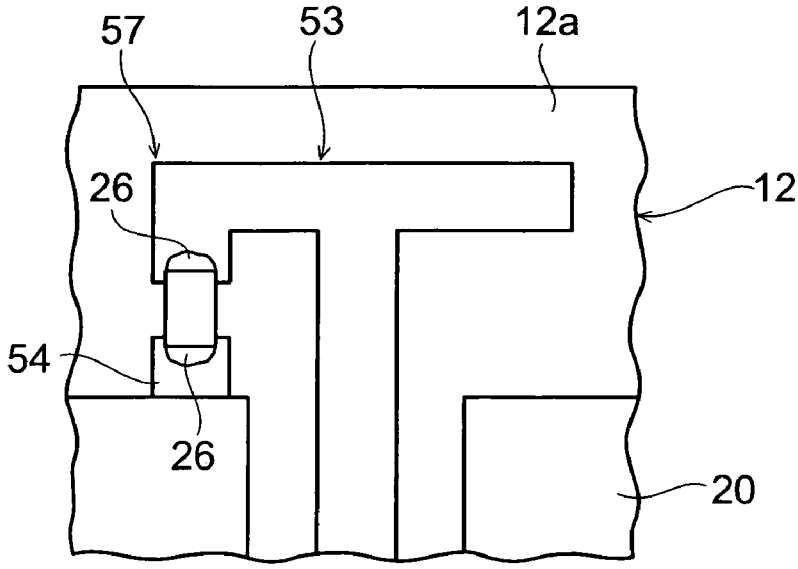

A variation of the antenna element will be described hereinbelow. The shape of the antenna element in plan view is not limited to the straight-line shape in the above embodiment and may have another optional shape that permits a monopole antenna constitution. For example, as shown in FIG. 10(*a*), two electric conductors 51 and 52 in the antenna element and the inductor 18 connected between the two conductors 51 and 52 may form an inverted L shape. That is, the inductor 18 may be inserted in an inverted L-shaped antenna conductor 56 including the conductors 51 and 52. Further, as shown in FIG. 10(*b*), two electric conductors 53 and 54 in the antenna element and the inductor 18 connected between the two conductors 53 and 54 may form an inverted F shape. That is, the inductor 18 may be inserted in an inverted F-shaped antenna conductor 57 including conductors 53 and 54.

Furthermore, the inductor 18 may be connected in series to the proximal end (the end adjacent to the grounding conductor 20) or the distal end (the open end placed away from the grounding conductor 20) of the antenna conductor instead of being inserted in series in the antenna conductor. For example, in the antenna element 15 shown in FIG. 1, the inductor 18 may be inserted between the conductors 14*a* and 14*b* or may be connected to the open end of the conductor 16. In either case, the inductor 18 is connected in series to the conductor 14*a* or 16. As is clear from FIG. 6, the appropriate $X_L/K_a$ decreases with increase in the proportionality coefficient of h to λ even if the inductor is connected to either end of the antenna conductor, and thus the same benefits as those of the above embodiment can be obtained.

Furthermore, the inductor connected between the two conductors constituting the antenna element is not limited to having the structure of the embodiment and can have a variety of other structures. Various variations of the inductor will be described hereinbelow.

Figure 11:
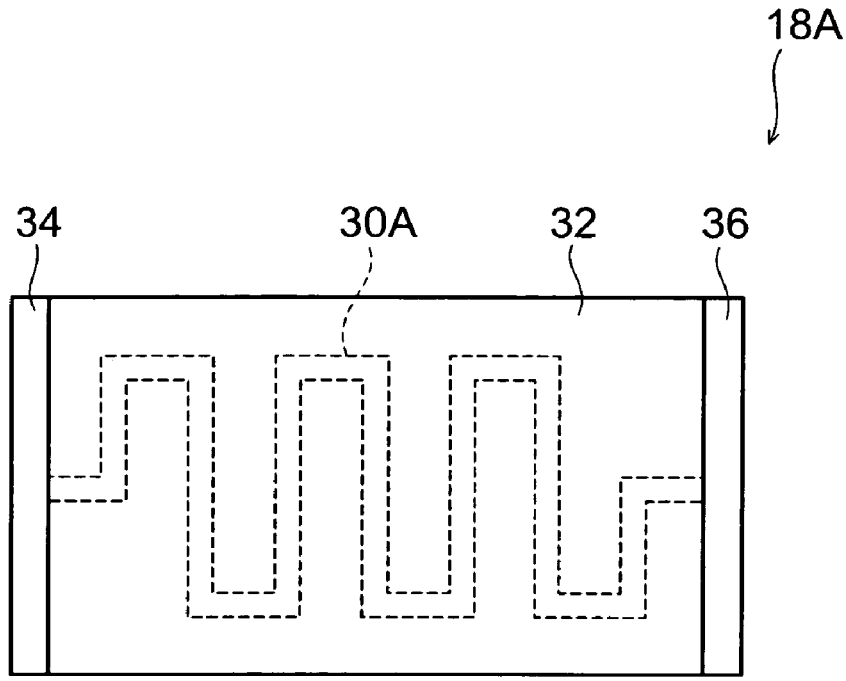
FIG. 11 shows the first variation of the inductor in the first embodiment.
Figure 11:
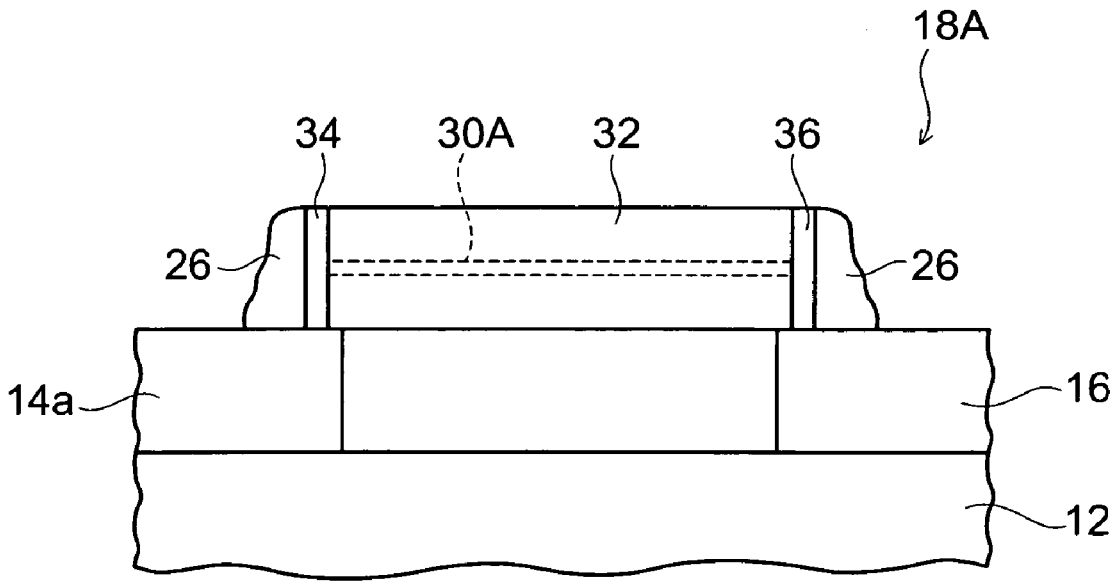

FIG. 11 shows the first variation of the inductor, where (a) and (b) are a plan view and a side view of the inductor, respectively. The shape of the conductor embedded in the magnetic material 32 of the inductor 18A differs from the shape of the inductor 18 above. As shown in FIG. 11(*a*), a conductor 30A in the inductor 18A is a line conductor meandering between the two electrodes 34 and 36.

The cross-sectional area of the conductor 30A is smaller than those of the conductors 14*a* and 16, and therefore, the conductor 30A, which is electrically connected between the conductors 14*a* and 16, produces an inductance. The meandering conductor 30A can provide a longer current path between the conductors 14*a* and 16 than a straight conductor can. As a result, a larger inductance can be obtained.

Figure 12:
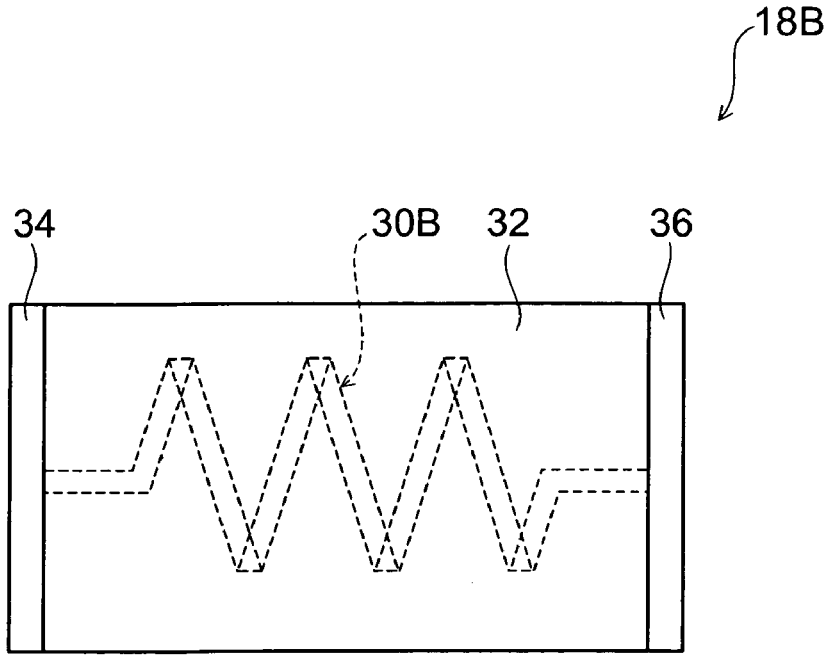
FIG. 12 shows the second variation of the inductor in the first embodiment.
Figure 12:
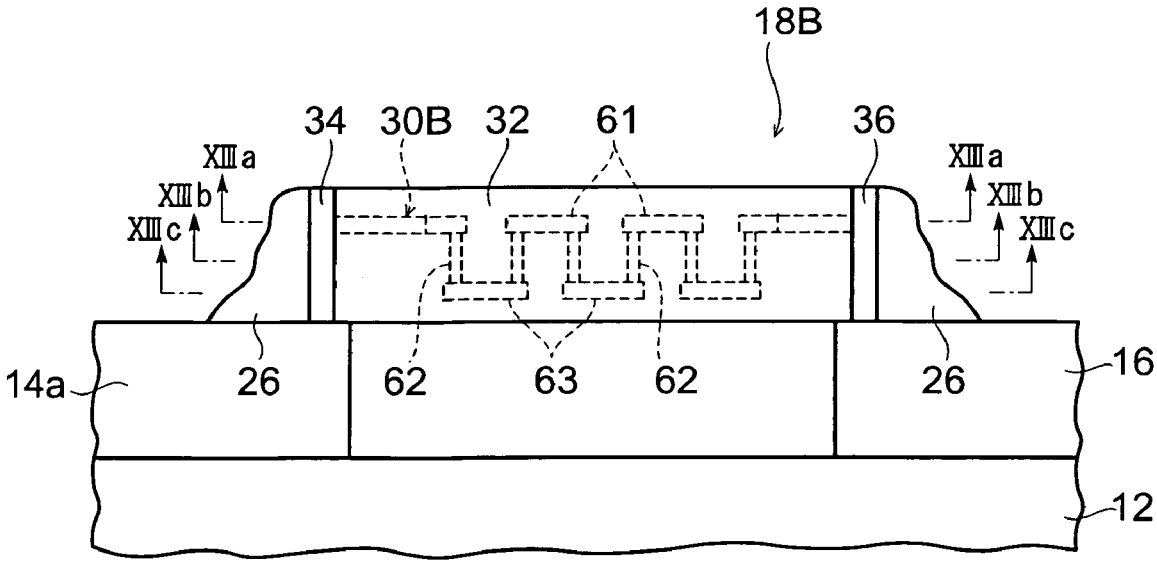
Figure 13:
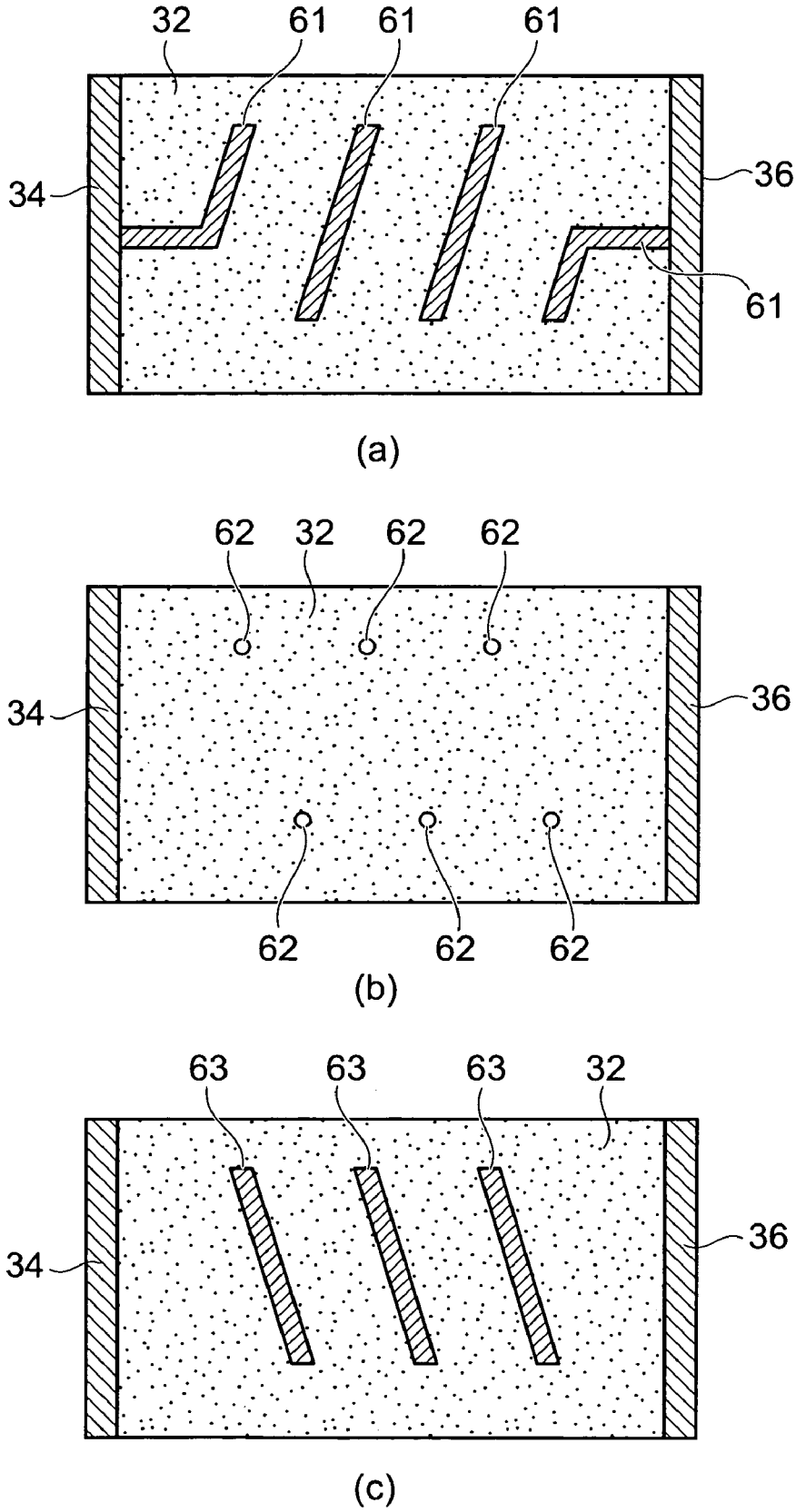
FIG. 13 shows various cross sections of the inductor shown in FIG. 12.

FIG. 12 shows the second variation of the inductor, where (a) and (b) are a plan view and a side view of the inductor, respectively. Further, FIG. 13 shows various cross-sections of this inductor, where (a), (b), and (c) are cross-sectional views taken along lines XIIIa-XIIIa, XIIIb-XIIIb, and XIIIc-XIIIc of FIG. 12(*b*), respectively. The shape of the conductor embedded in the magnetic material 32 of the inductor 18B differs from the shape of the inductor 18 above. As shown in FIG. 12, a conductor 30B in the inductor 18B is a line conductor extending helically between the two electrodes 34 and 36. As shown in FIGS. 12(*b*) and 13, the conductor 30B is configured of four conductors 61, three conductors 63 disposed below these strip conductors 61, and vias 62 extending between the conductors 61 and 63. The conductors 61 are disposed at the same height, and two of them are connected to the electrodes 34 and 36. The conductors 63 are disposed at the same height, and the opposite ends of each conductor 63 overlap one end of the respective two conductors 61. The vias 62 extend between these overlapping portions, whereby the conductors 61 and the conductors 63 are electrically connected.

The cross-sectional area of the conductor 30B is smaller than those of the conductors 14*a* and 16, and therefore, the conductor 30B, which is electrically connected between the conductors 14*a* and 16, produces an inductance. The helical conductor 30B can provide a longer current path between the conductors 14*a* and 16 than a straight-line conductor can. As a result, a larger inductance can be obtained. Although the number of turns of the conductor 30B is three in FIGS. 12 and 13, any number of turns may be chosen.

Figure 14:
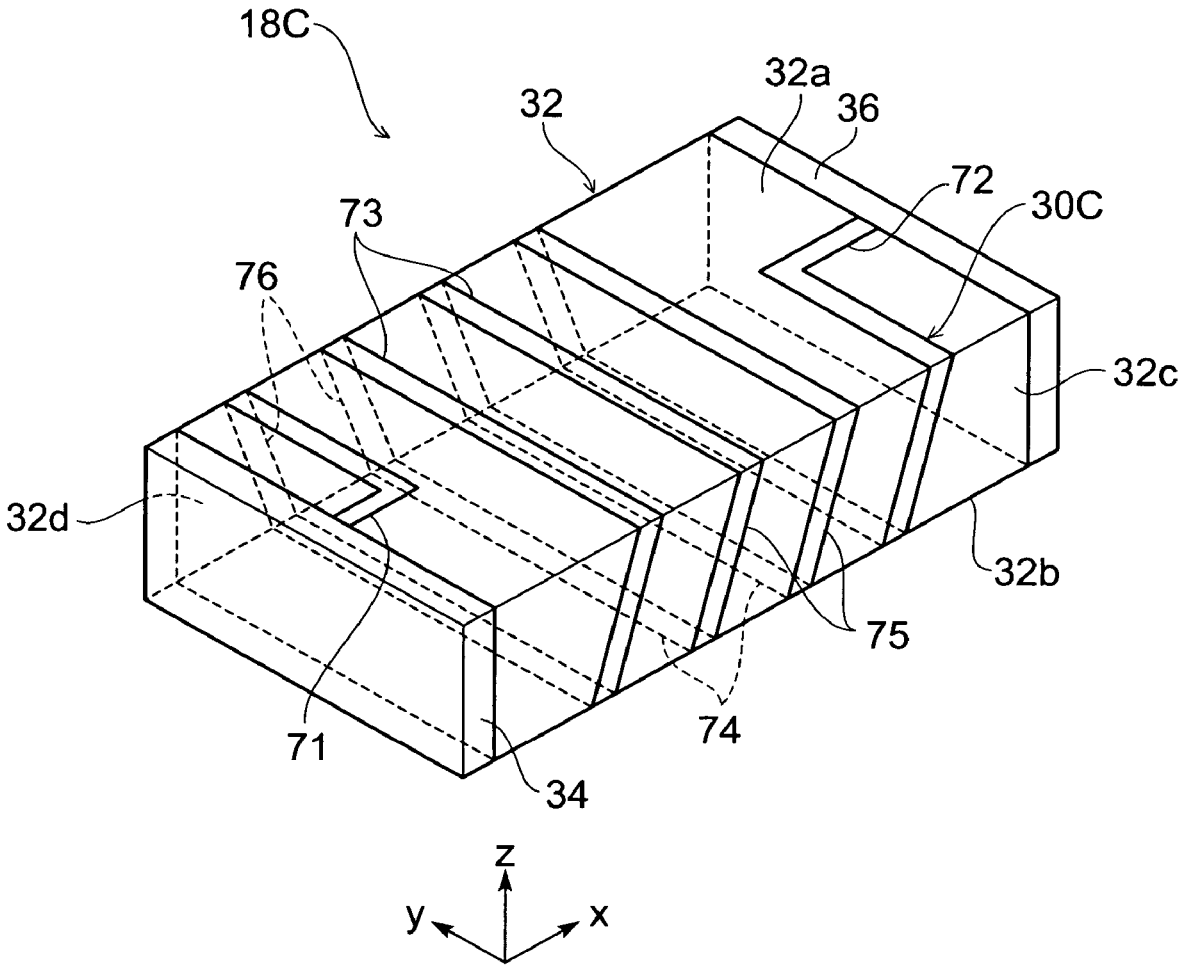
FIG. 14 is a perspective view showing the third variation of the inductor in the first embodiment.

FIG. 14 is a perspective view of the third variation of the inductor. A conductor is embedded in a magnetic material in the above inductors 18, 18A and 18B; however, in the inductor 18C shown in FIG. 14, a strip conductor 30C extends between the electrodes 34 and 36 while being wound helically around the surface of the magnetic material 32. The opposite ends 71 and 72 of the conductor 30C are connected to the electrodes 34 and 36, respectively, on the upper face 32*a* of the magnetic material 32 which is a right rectangular prism. Strip parts 73 of the conductor 30C disposed on the upper face 32*a* of the magnetic material 32 extend in parallel in the width direction (y direction) of the magnetic material 32. Likewise, strip parts 74 disposed on the lower face 32*b* of the magnetic material 32 also extend in parallel in the width direction of the magnetic material 32. On the other hand, strip parts 75 and 76 on the opposite sides 32*c* and 32*d* of the magnetic material 32 extend obliquely from the conductor 36 toward the conductor 34. The strip parts 73 and 74 may also extend obliquely from the conductor 36 toward the conductor 34 on the upper and lower faces, respectively, of the magnetic material 32. Also, all or some of the strip parts may extend obliquely from the conductor 34 toward the conductor 36.

Because the conductor 30C is wound around the surface of the magnetic material 32 between the two electrodes 34 and 36, when a current flows in the conductor 30C, the inductor 30C acts as a coil and produces an inductance. Further, although the number of turns of the conductor 30C is four in FIG. 14, any number of turns may be chosen.

Second Embodiment

Figure 15:
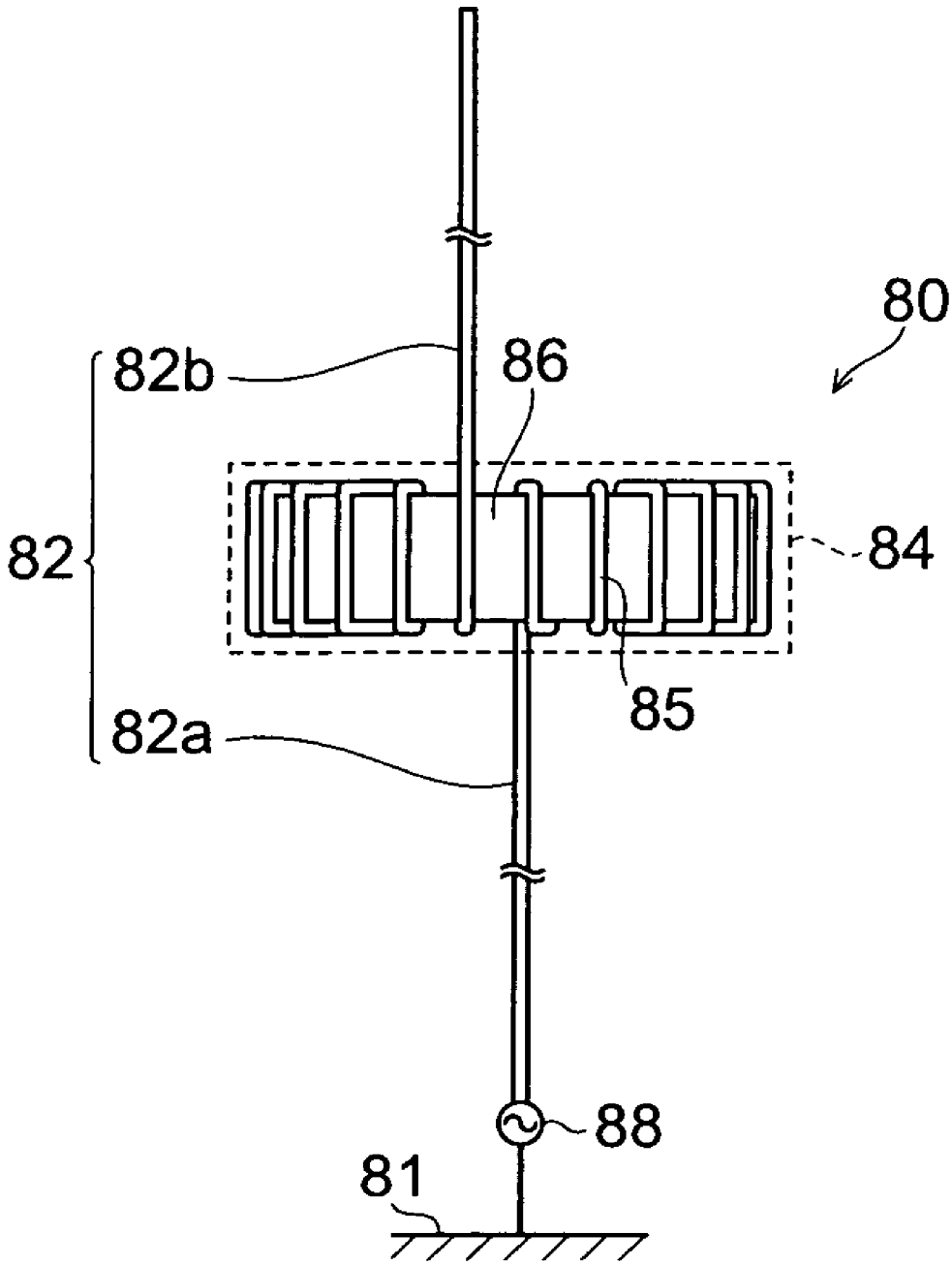
FIG. 15 is a schematic side view of an antenna of the second embodiment.

The second embodiment of the present invention will now be described. This embodiment relates to a line monopole antenna which is easy to manufacture and is used in various applications. FIG. 15 is a schematic side view of a monopole antenna in accordance with this embodiment. The monopole antenna 80 is a ground-mounted vertical antenna that is erected perpendicularly to a ground face 81. The monopole antenna 80 includes an antenna conductor wire 82 shaped in a straight line, and an inductor 84 inserted in the antenna conductor wire 82 to be connected in series therewith. The antenna conductor wire 82 has a first linear portion 82*a* connected to one end of the inductor 84 and a second linear portion 82*b* connected to the other end of the inductor 84. These linear portions have the same diameter.

The antenna 80 is mainly described as a transmitting antenna and the antenna conductor wire 82 is mainly described as a transmitting element hereinbelow. However, the antenna 80 naturally has an ability to receive radio waves, and therefore the antenna conductor wire 82 is also a receiving element.

The end of the first linear portion 82*a* on the side away from the inductor 84 is connected to a power supply 88. The power supply 88 is connected to the ground face 81. The end of the second linear portion 82*b* on the side away from the inductor 84 is an open end.

Figure 16:
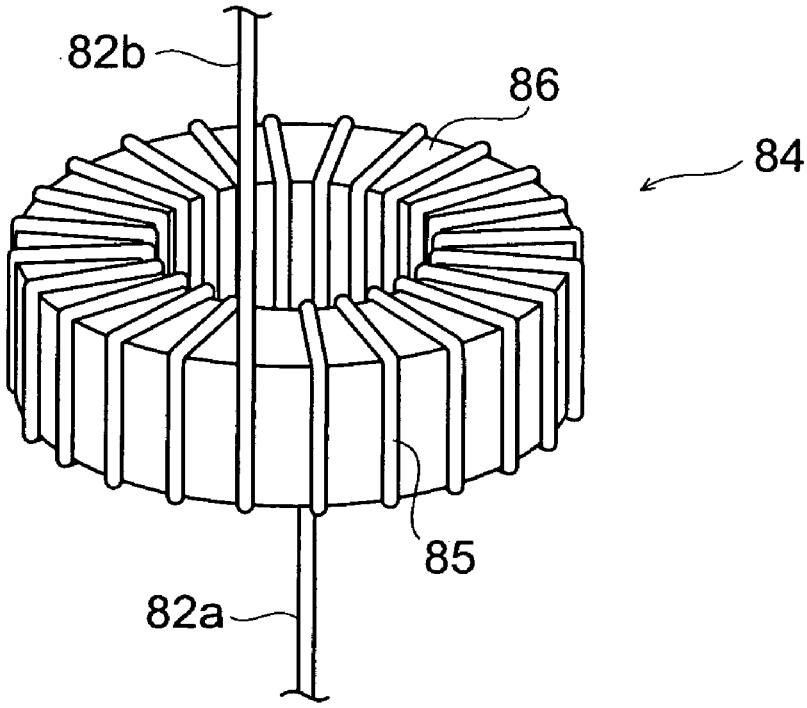
FIG. 16 is a view to illustrate the inductor in the second embodiment.
Figure 16:
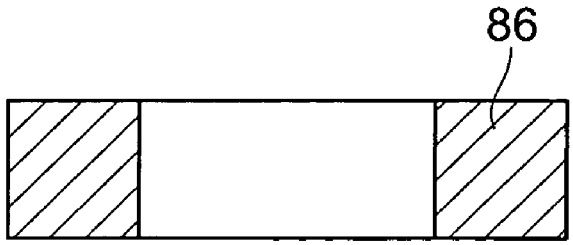

The inductor 84 is a coil including a conductor wire 85 extending between the linear portions 82*a* and 82*b*, and a core 86 around which the conductor wire 85 is wound. FIG. 16 shows the structure of the inductor 84, where (a) is a schematic perspective view of the inductor 84, and (b) is a cross-sectional view of the core 86 of the inductor 84. As shown in FIG. 16, the core 86 is toroidal, and therefore the inductor 84 is a toroidal coil. The conductor wire 85 has the same diameter as those of the first linear portion 82*a* and the second linear portion 82*b*.

The power supply 88 includes a radio-frequency (RF) circuit. When a radio-frequency electrical power is supplied from the radio-frequency circuit to the antenna conductor wire 82, a radio wave can be emitted by the antenna conductor wire 82. When the antenna 80 is used as a receiving antenna, the antenna conductor wire 82 receives and converts an incoming radio wave into a radio-frequency electric signal, and outputs the electric signal from the first linear portion 82*a*.

The antenna conductor wire 82 is a center loading antenna with an inductor, which is a reactance element, inserted in the antenna conductor wire 82. As is commonly known, the inductor contributes to reduction in the height of the antenna conductor wire with respect to the ground face 81. This fact will be described hereinbelow with reference to FIG. 17.

Figure 17:
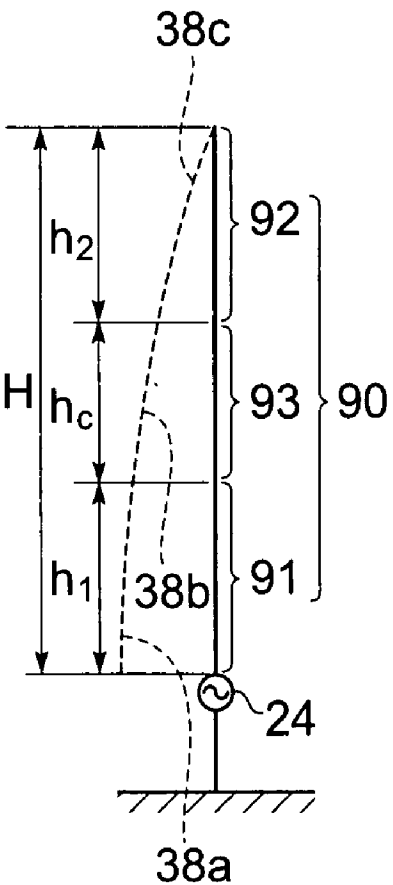
FIG. 17 is a schematic plan view to illustrate reduction in the height of an antenna conductor wire.
Figure 17:
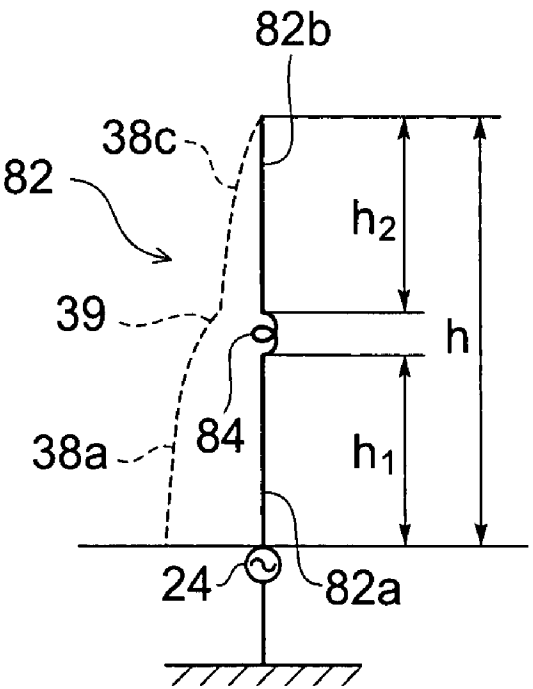

FIG. 17 is a schematic plan view to illustrate the reduction in the height of the antenna conductor wire, where (a) is a partial plan view of the antenna conductor wire 82 of this embodiment, and (b) a partial plan view of an antenna conductor wire 90 without an inserted inductor. This straight antenna conductor wire 90 has the same diameter as that of the antenna conductor wire 82. The antenna conductor wire 90 includes three successive parts 91 to 93. The parts 91 and 92 each have lengths $h_1$ and $h_2$ which are same as those of the linear portions 82*a* and 82*b* of the antenna conductor wire 82, respectively.

The broken lines in FIGS. 17(*a*) and (*b*) represent the amplitude of the current in the antenna conductor wire. As shown in FIG. 17(*a*), the reactance generated by the inductor 84 provides a current amplitude distribution 39 that changes sharply along the length of the antenna conductor wire, between current amplitude distributions 38*a* and 38*c* in the first and second linear portions 82*a* and 82*b*. As shown in FIG. 17(*b*), in order to connect the current amplitude distributions 38*a* and 38*c* by means of only the antenna conductor wire 90 without using the inductor 84, it is necessary to use an antenna conductor wire 93 (with length $h_c$) that is longer than the inductor 84 to provide a current amplitude distribution 38*b* that smoothly connects the current amplitude distributions 38*a* and 38*c*. It is clear from this fact that the height of the antenna conductor wire with respect to the ground face 81 can be reduced by inserting the inductor 84 in the antenna conductor wire. This means that the antenna conductor wire 82 in which the inductor 84 is loaded apparently operates in the same way as the antenna conductor wire 90 with length H, as shown in FIG. 17(*b*).

The appropriate reactance of the inductor 84 will now be studied. As is commonly known, the reactance of an inductor connected to an antenna conductor wire of a monopole antenna preferably satisfies Equation (1) that is provided again below:

$$\frac{X_L}{K_a} = \cot\left(\frac{2\pi}{\lambda}h_2\right) - \cot\left[\frac{2\pi}{\lambda}(H - h_1)\right], \tag{1}$$

where, $X_L$ is the reactance of the inductor 84, and $K_a$ is the average characteristic impedance of the antenna conductor wire 82. $K_a$ is a constant determined in accordance with the shape of the antenna conductor wire 82. H is the apparent height of the antenna conductor wire 82 with respect to the ground face 81, as shown in FIG. 17(*b*). In is the length of the first linear portion 82*a* of the antenna conductor wire 82, $h_2$ the length of the second linear portion 82*b*, and λ is the wavelength of the radio wave transmitted or received by the antenna conductor wire 82.

For the sake of simplification, H is set at a typical (¼) λ hereinbelow. Here, Equation (1) is rewritten as Equation (2) which is provided again below:

$$\frac{X_L}{K_a} = \cot\left(\frac{2\pi}{\lambda}h_2\right) - \tan\left(\frac{2\pi}{\lambda}h_1\right). \tag{2}$$

The relationship between $h_1/h$ and $X_L/K_a$ based on Equation (2) is shown in FIG. 6. In this embodiment, $h_1/h$ is a parameter representing a position at which the inductor 84 is inserted in the antenna conductor wire 82. As mentioned above, when $h_1/h$ is fixed, the appropriate reactance $X_L$ of the inductor 84 decreases with increase in the proportionality coefficient of height h of the antenna conductor wire 82 to wavelength λ.

The relationship between $X_L/K_a$ which satisfies Equation (2) and frequency f under the condition where $h_1=h_2$, $h_1/h=0.5$, and h is constant is shown in FIG. 7. As mentioned above, if the position of the inductor 84 is fixed, the appropriate $X_L/K_a$ decreases as the proportionality coefficient of h to λ increases. On the other hand, in order to keep constant the height h of the antenna conductor wire 82, which is expressed as wavelength λ multiplied by the proportionality coefficient, λ needs to decrease as the proportionality coefficient increases. Because λ and f are inversely proportional as is well known, in order to keep h constant, f needs to increase as the proportionality coefficient increases. Therefore, if $X_L$ decreases with increase in f as shown in FIG. 7, an appropriate $X_L/K_a$ can be obtained at various frequencies without changing height h of the antenna conductor wire 82. This means that it is possible to obtain a monopole antenna that can be operated over a wide frequency bandwidth. without increasing the size of the antenna.

As described earlier in the first embodiment, in comparison with a case where $X_L$ changes with a positive gradient with respect to f, an adequate antenna performance can be obtained over a wider frequency bandwidth while keeping h constant if $X_L$ changes with a negative gradient with respect to f As a result, it is possible to broaden the frequency bandwidth in which the antenna 80 can operate (that is, in which the antenna 80 can be used), while suppressing the enlargement of the antenna 80.

In the present embodiment, in order to obtain the above frequency characteristic of reactance $X_L$, a magnetic material having a permeability μ that varies with a negative gradient as frequency f increases is used for the core 86 of the inductor 84. More specifically, a hexagonal-system ferrite with the characteristic shown in FIG. 9 is used as a material of the core 86. As mentioned earlier, permeability μ of the ferrite varies with a negative gradient with respect to the frequency in a sufficiently high frequency region, and therefore the frequency characteristic of reactance $X_L$ denoted by the solid line in FIG. 8 is obtained.

Thus, a characteristic identical or approximate to the ideal frequency characteristic of $X_L/K_a$ shown in FIG. 7 can be obtained by using the coil 84 having the core 86 with a permeability that varies with a negative gradient with respect to frequency f As a result, it is possible to broaden the operating frequency bandwidth of the antenna 80 while suppressing the enlargement of the antenna 80.

The inductor 84 is not limited to a toroidal coil as in the above embodiment and may be any other coil. Further, an inductor other than a coil can also be used. Various variations of the inductor will be described hereinbelow.

Figure 18:
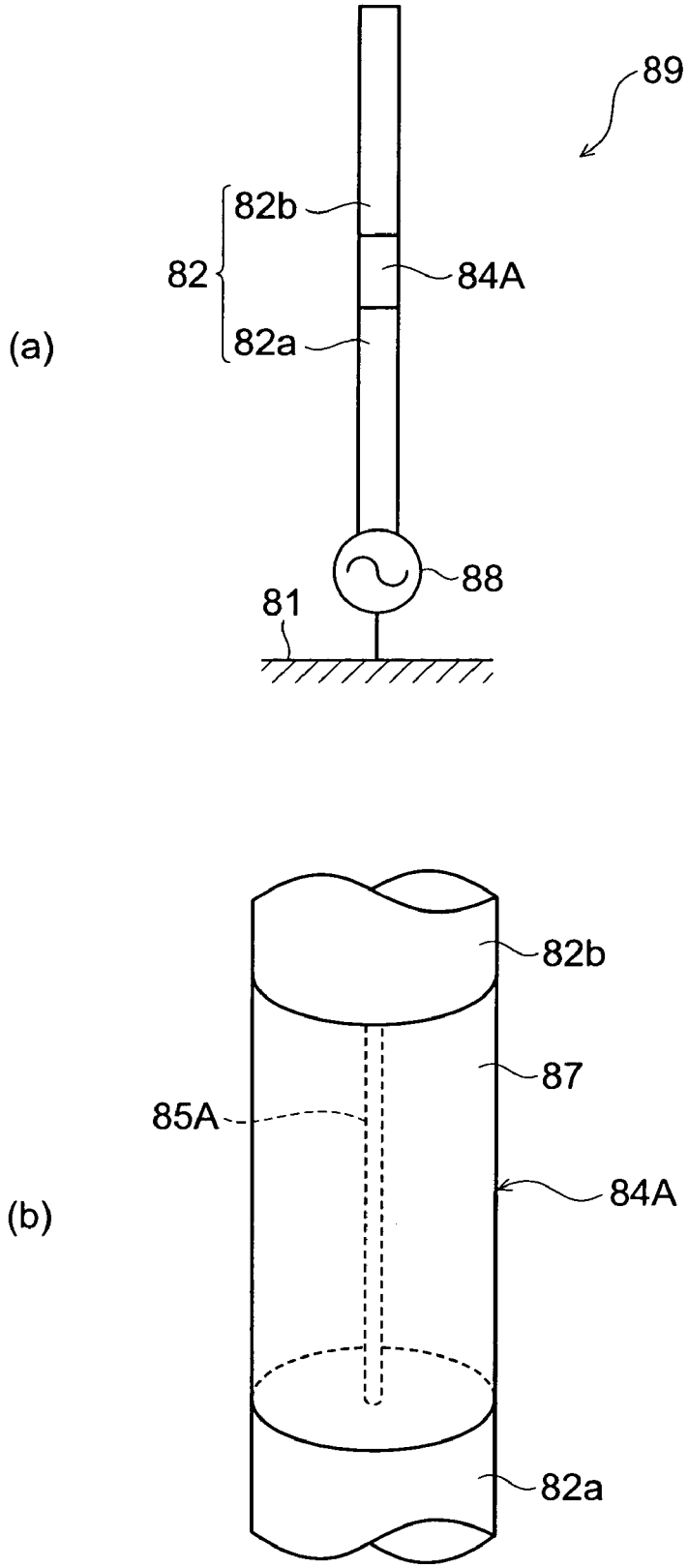
FIG. 18 is a view to illustrate the first variation of the inductor in the second embodiment.

FIG. 18 shows an inductor 84A according to the first variation, where (a) is a schematic side view of a monopole antenna 89 including the inductor 84A, and (b) is an enlarged perspective view of the inductor 84A. The inductor 84A has a straight conductor wire 85A connected between two linear portions 82*a* and 82*b* of the antenna conductor wire 82. The conductor wire 85A is embedded in a circular magnetic material 87 and extends on the central axis of the material 87. The diameter of the magnetic material 87 is the same as that of the conductor wire 82.

The cross-sectional area (sectional area perpendicular to the direction in which the current flows) of the conductor wire 85A is smaller than those of the linear portions 82*a* and 82*b*. Therefore, the conductor wire 85A operates as an inductor when a current flows through these conductor wires. The magnetic material 87 covering the side of the conductor wire 85A serves to increase the inductance of the inductor.

The magnetic material 87 has a permeability that varies with a negative gradient with respect to the frequency in the same way as the core 86 of the inductor 84. Hence, the antenna 89 has the same advantages as the antenna 80 of the first embodiment.

Figure 19:
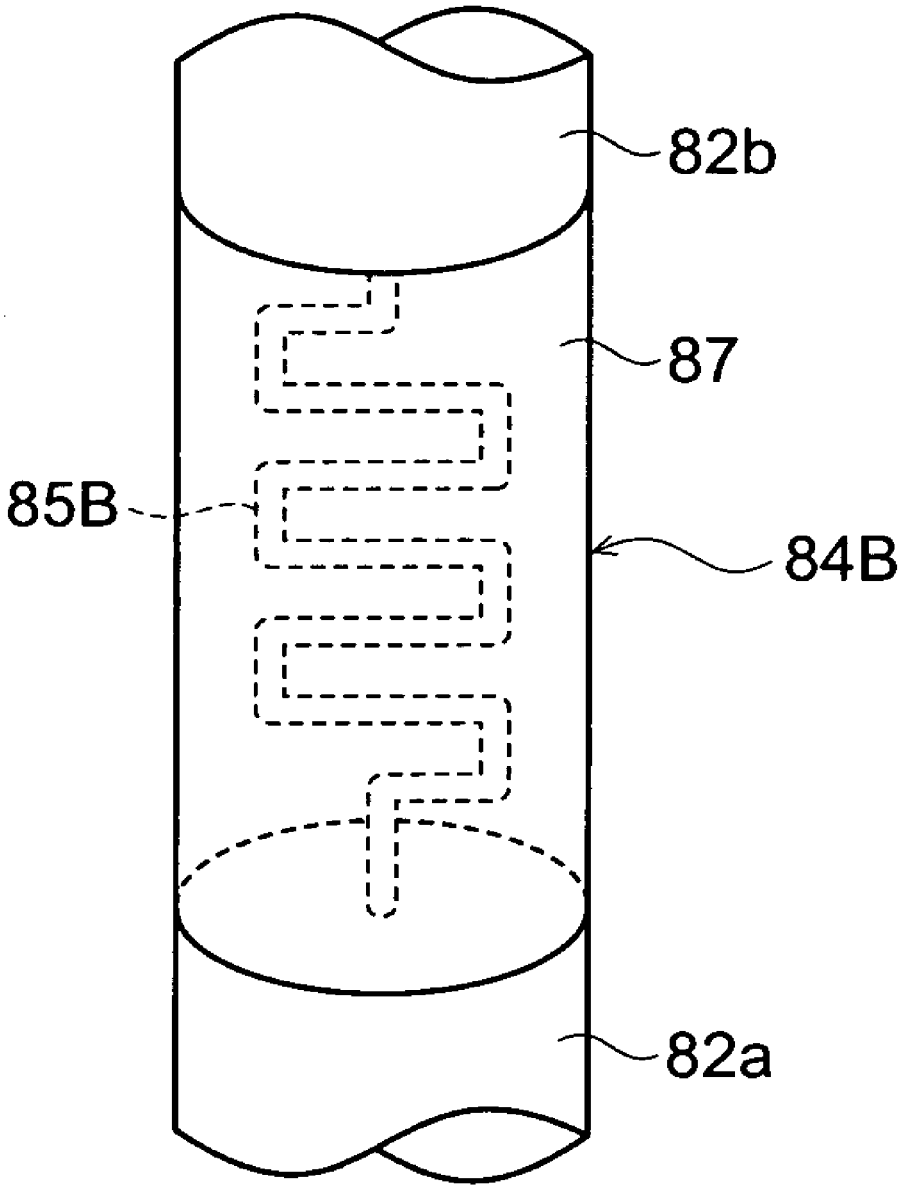
FIG. 19 is an enlarged perspective view of the second variation of the inductor in the second embodiment.

The inductor 84A of the antenna 89 can also be replaced with an inductor 84B shown in FIG. 19. FIG. 19 is an enlarged perspective view of the inductor 84B according to the second variation. The inductor 84B differs from the inductor 84A in the shape of the conductor wire embedded in the magnetic material 87. As shown in FIG. 19, the conductor wire 85B in the inductor 84B meanders between the two linear portions 82*a* and 82*b* of the antenna conductor wire 82.

The cross-sectional area of the conductor wire 85B is smaller than those of the linear portions 82*a* and 82*b* of the antenna conductor wire 82, and therefore the conductor wire 85B produces an inductance. The meandering conductor wire 85B can provide a longer current path between the linear portions 82*a* and 82*b* than a straight conductor wire can. As a result, a larger inductance can be obtained.

Having described the present invention as related to the above embodiments, it is to be understood that the invention is not limited to the embodiments, and various modifications can be made without departing from the spirit and scope of the invention.

Although the magnetic material is in contact with the conductor in the inductor in the above embodiments, an electric insulator may be interposed between the conductor in the inductor and the magnetic material, and therefore the conductor and the magnetic material may not be in contact, as seen in some well-known thin-film-type inductors. That is, if the magnetic material is disposed close to the conductor to the extent of affecting the inductance produced by the conductor in the inductor, the magnetic material acts as a magnetic core of the inductor.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A monopole antenna, comprising:

an antenna conductor adapted to transmit or receive a radio wave having a frequency;

an inductor either inserted in the antenna conductor or connected to an end of the antenna conductor;

a support plate having a principal face for the antenna conductor and the inductor to be disposed on; and a grounding conductor provided on the principal face of the support plate, the inductor including a first conductor electrically connected to the antenna conductor, and a magnetic material adjacent to the first conductor, and the magnetic material having a permeability varying with a negative gradient with respect to the frequency of the radio wave.

2. A monopole antenna according to claim 1, wherein the inductor further includes a first electrode electrically connected to a first end of the first conductor, and a second electrode electrically connected to a second end of the first conductor, and the first conductor is electrically connected to the antenna conductor via at least one of the first and second electrodes.

3. A monopole antenna according to claim 1, wherein the first conductor is embedded in the magnetic material.

4. A monopole antenna according to claim 3, wherein the antenna conductor includes a second conductor having an end connected to an end of the first conductor, and the end of the first conductor has a first cross-sectional area perpendicular to a direction of current flow in the first conductor, the end of the second conductor has a second cross-sectional area perpendicular to a direction of current flow in the second conductor, and the first cross-sectional area is smaller than the second cross-sectional area.

5. A monopole antenna according to claim 1, wherein the first conductor is wound around the magnetic material.

6. A monopole antenna according claim 1, wherein the antenna conductor and the first conductor each include a conductor wire.

7. A monopole antenna according to claim 6, wherein the inductor includes a coil having the first conductor, the first conductor being wound around the magnetic material.

8. A monopole antenna, comprising:

an antenna conductor adapted to transmit or receive a radio wave having a frequency; and an inductor either inserted in the antenna conductor or connected to an end of the antenna conductor, the inductor including a first conductor electrically connected to the antenna conductor, and a magnetic material adjacent to the first conductor, and the magnetic material having a permeability varying with a negative gradient with respect to the frequency of the radio wave, wherein the antenna conductor and the first conductor each include a conductor wire, and the first conductor is embedded in the magnetic material.

9. A monopole antenna according to claim 8, wherein the antenna conductor includes a second conductor having an end connected to an end of the first conductor, and the end of the first conductor has a first cross-sectional area perpendicular to a direction of current flow in the first conductor, the end of the second conductor has a second cross-sectional area perpendicular to a direction of current flow in the second conductor, and the first cross-sectional area is smaller than the second cross-sectional area.

* * * * *